United States Patent [19]

Prader et al.

[11] Patent Number: 4,493,419

[45] Date of Patent: Jan. 15, 1985

[54] THERMOPLASTIC BAG AND BAG PACK

[75] Inventors: Randolph D. Prader, Fairport; Gordon L. Benoit, Macedon; Robert T. Maddock, West Rush, all of N.Y.

[73] Assignee: Mobil Oil Corporation, New York, N.Y.

[21] Appl. No.: 548,487

[22] Filed: Nov. 3, 1983

[51] Int. Cl.[3] ..... B65D 1/34; B65D 6/04

[52] U.S. Cl. ..... 206/554; 383/9; 383/26

[58] Field of Search ..... 206/554; 383/6–10, 383/13, 26

[56] References Cited

U.S. PATENT DOCUMENTS

| | | | |
|---|---|---|---|
| 3,317,037 | 5/1967 | Russell | 206/554 |
| 3,352,411 | 11/1967 | Schwarzkopf | 206/554 |
| 4,165,832 | 8/1979 | Kuklies et al. | 206/554 |

FOREIGN PATENT DOCUMENTS

| | | | |
|---|---|---|---|
| 2442715 | 3/1976 | Fed. Rep. of Germany | 206/554 |
| 2803961 | 8/1978 | Fed. Rep. of Germany | 206/554 |
| 2314871 | 1/1977 | France | 206/554 |
| 2427982 | 1/1980 | France | 206/554 |
| 60617 | 2/1948 | Netherlands | 206/554 |

*Primary Examiner*—Joseph Man-Fu Moy

*Attorney, Agent, or Firm*—Alexander J. McKillop; Michael G. Gilman; James P. O'Sullivan

[57] ABSTRACT

A bag pack of a plurality of stacked thermoplastic bag structures each bag comprising a front and rear bag wall and an open mouth top portion. Handles are integral extensions of the bag walls. The bags are bonded together via bonding means in association with said handles. Individual bags may have stress relief curves in the handles and the bag mouth opening.

7 Claims, 6 Drawing Figures

FIG. 1
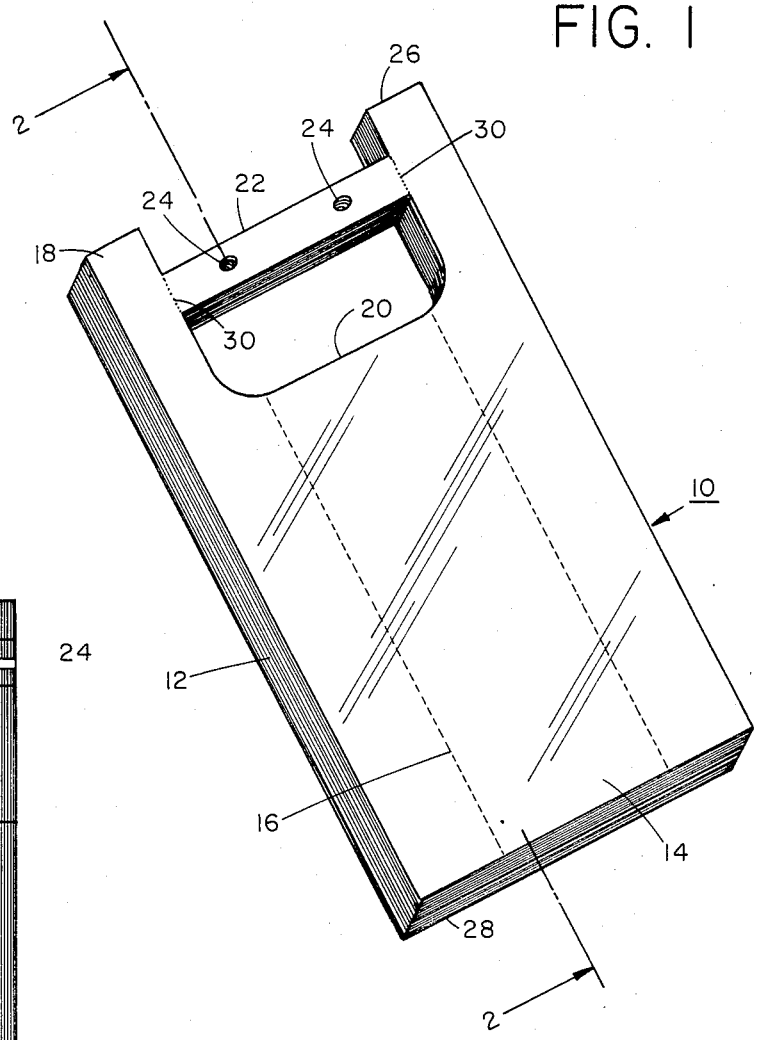
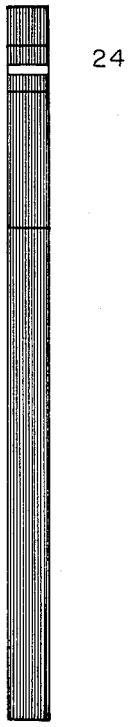
FIG. 2

THERMOPLASTIC BAG AND BAG PACK

BACKGROUND OF THE INVENTION

This invention relates to a handled thermosplastic bag structure and individual packs of a plurality of such bag structures.

In the recent past, thermoplastic handled grocery sacks have begun to compete with kraft paper grocery sacks, which still dominate the market by a large margin. Thermoplastic grocery sacks have many advantages over the conventional kraft paper grocery sack. Included among these advantages are: superior tear strength; being completely waterproof, and not subject to failure when contacted with liquids; the convenience of handles; faster loading than kraft paper bags; has more and better secondary use capabilities; has greater density and, therefore, will occupy less space, than kraft paper bags; etc.

A conventional manner of providing such handled thermoplastic sacks is to arrange them in a lay flat stack of 50, 100 or more, and bond them together by way of tabs which extend upwardly from the bag mouth opening. This tab, in addition to providing the site at which the plurality of bags are bonded together, also constitutes the tear-off site of each bag from the bonded tabs. These bonded tabs also provide the site from which the pack of bags can be suspended from some suitable support means. For example, a peg or similar suspension means may extend through an orifice in said tabs. U.S. Pat. No. 4,165,832, issued Aug. 28, 1979, the subject matter of which is, in its entirety, incorporated herein by reference, is an example of the type of thermoplastic grocery sack which forms the subject of the instant invention.

This type of thermoplastic handled bag, particularly in pack form and when suspended by the above-described central tab arrangement, leaves the individual collection of handles unsupported and in a limp state of disarray, which tends to slow down the act of dispensing and loading individual bags. Any means of keeping the bags in an orderly stack during transportation or in use, particularly during dispensing and filling, would clearly be an advance in the art.

SUMMARY OF THE INVENTION

The bag pack of the present invention comprising a plurality of stacked thermoplastic bag structures, each bag comprising a front and rear bag wall and an open mouth top portion, said open mouth portion being characterized by having handles which are integral extensions of said walls, said handles being located at opposite ends of said mouth portion, said handles being in association with but detachable from a bag bonding means, bonding said bag structures into a bag pack. A preferred bonding means comprises at least one web detachably but continuously extending from one oppositely disposed handle to the other of each bag, the webs being bonded together. Another preferred bag bonding means comprises at least one tab detachably extending from said handles.

A preferred means of detaching the handles of the grocery sack from the web or tab bonding means is by means of preweakened areas or regions between the handles and the web or tab means. These preweakened regions can be perforations or regions of reduced material thickness. When employing such means of detachment in certain instances, the handles will have nicked or somewhat uneven edges which are prone to tear under the weight of a loaded bag. In such instances, it is preferred to place a stress relief curve or area at the base of the handles between said weakened area of the handle and the load carrying region of the bag. Such stress relief curves, areas or structures will tend to move the stress lines away from any ragged cut or nicked edges of the handle and into a more central portion of the handle thereby effectively decreasing any tendency of the handle to tear.

BRIEF DESCRIPTION OF THE DRAWINGS

FIG. 1 is a perspective view of a stack of one form of the bag structures of the present invention.

FIG. 2 is a cross-sectional view taken on line 2-2 of FIG. 1.

DETAILED DESCRIPTION OF THE INVENTION

Figure 3:
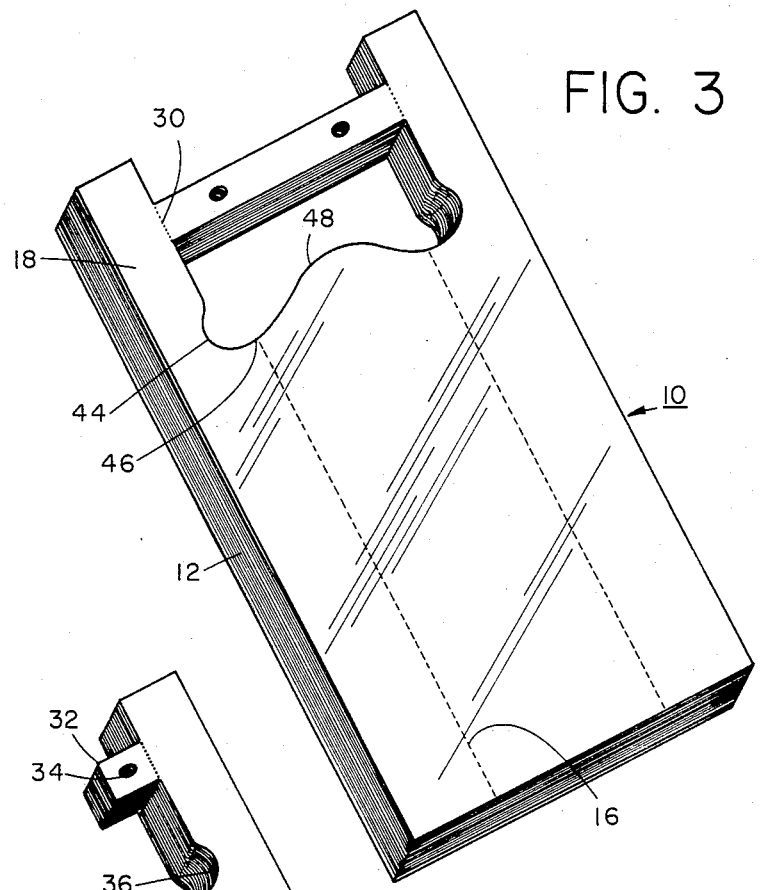
FIG. 3 is a perspective view of another preferred form of the bag pack structures of the present invention.

One form of the bag pack and bag structure of the present invention, shown in FIGS. 1 and 2 of the accompanying drawing, generally comprises a bag fabricated from a flattened gusseted thermoplastic tube. FIG. 1 shows bag pack 10 which comprises a plurality of stacked individual bags 12. Each individual bag has a front wall 14 and a rear wall opposite thereto not shown. The side walls of the bag are inwardly folded gussets or accordian pleats 16, which allow for bag expansion when the bags are being loaded. This also provides a double ply thickness in the handle members 18. The upper portion of the bag structures have been cut away to form said handles 18, bag mouth opening 20 and web 22. Web 22 constitutes the bag bonding means when a plurality of webs 20 are bonded together, for example, by means of orifices 24 which are formed by heat penetration of the webs. This simultaneously forms orifices 24 and bonds the webs together to unitize the plurality of bags. FIG. 2 illustrates a cross-sectional view taken on line 2-2 of FIG. 1 so as to show the orifice 24 extending through the width of webs 22. These orifices can be of any shape or design and can be one orifice or a plurality of orifices. The bag pack can be effectively and efficiently hung from suitable support means, e.g. a peg or tongues which extend through the orifices and present the bag pack to the user.

The bag structures of the present invention may be formed into convenient unitary bag packs by the following process: a thermoplastic tube, for example, of a polyethylene film, is simultaneously flattened and gusseted so that the gussets extend inward from the sides to an extent such as is shown for example, in FIG. 1 at 16. These collapsed and gusseted tubes are, thereafter, sealed and severed at both ends along lines which ultimately constitute the seals at 26 and 28, as shown in FIG. 1. These sealed tubes result in the formation of a structure which can be considered as inwardly gusseted double end-sealed "pillow cases". Thereafter, a plurality of these end sealed "pillow cases" are stacked one upon the other and a suitably designed cutting die cuts through the stack and simultaneously forms handles 18, mouth area 20 and web 22. Orifices 24 may be formed simultaneously with this cutting or during a subsequent step. During this cutout operation either simultaneously therewith or just subsequent thereto, the handles may be rendered easily detachable from web 22. This can be accomplished either by providing preweakend regions between handle 18 and web 22 or by providing perforations 30 as shown in FIG. 1. The perforations 30 can be formed by a line of piercing or stamp-out members which can be part of the die cutting mechanism.

In use, the structure illustrated in FIG. 1 may be mounted on two extending pegs and when it is desired to remove an individual bag from the pack, the handles are torn from web 22 by separation of the same at perforations 30. Thereafter, the handles of the bag can be extended about the ears of a bag holding rack (not shown) of any convenient design in order to hold the bag mouth open for access to the interior of the bag.

After removal of the bag from the bag pack the topmost portion of the bag in its lay flat condition describes generally a simple U-shaped configuration. The bag mouth is usually cleanly cut along line 20 with the absence of any pre-nicked or torn regions. This is one of the advantages of the structure of FIG. 1. Thus, the bag mouth is manufactured without any regions that are predisposed to rip or tear during loading or strecthing of the handles over a bag support frame.

While there will be such torn or nicked regions in the area of separation from web 22, i.e. at 30, which do constitute preweakened areas, this region of the handle will more often than not be clenched in the customers' hands and will be prevented from being the initiation point of a serious tear or rip.

Figure 4:
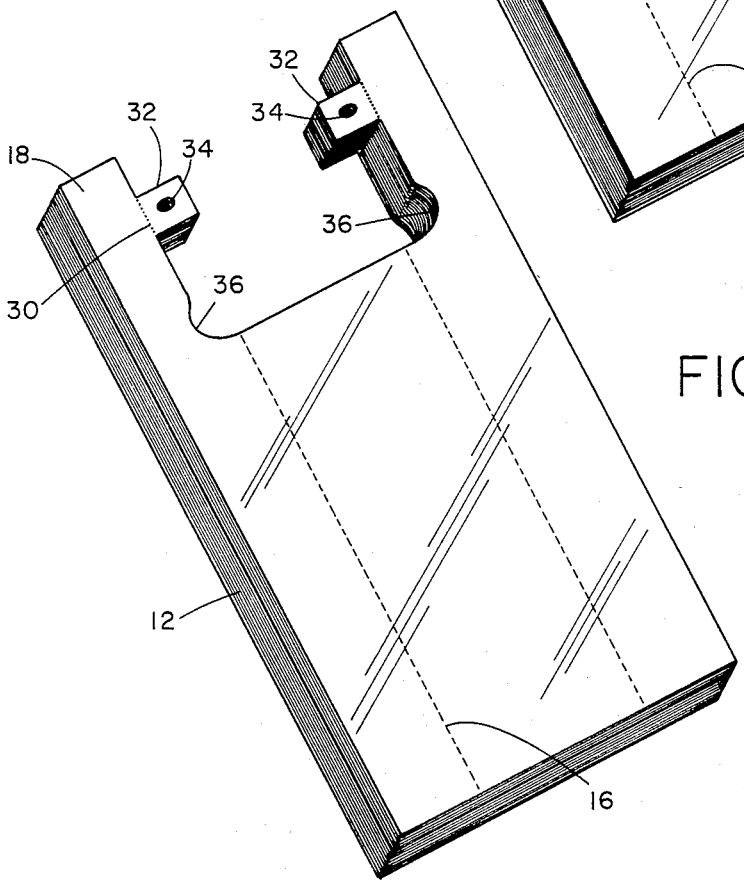
FIG. 4 is a perspective view of a preferred modified form of the bag pack structures illustrated in FIGS. 1 and 3.
Figure 5:
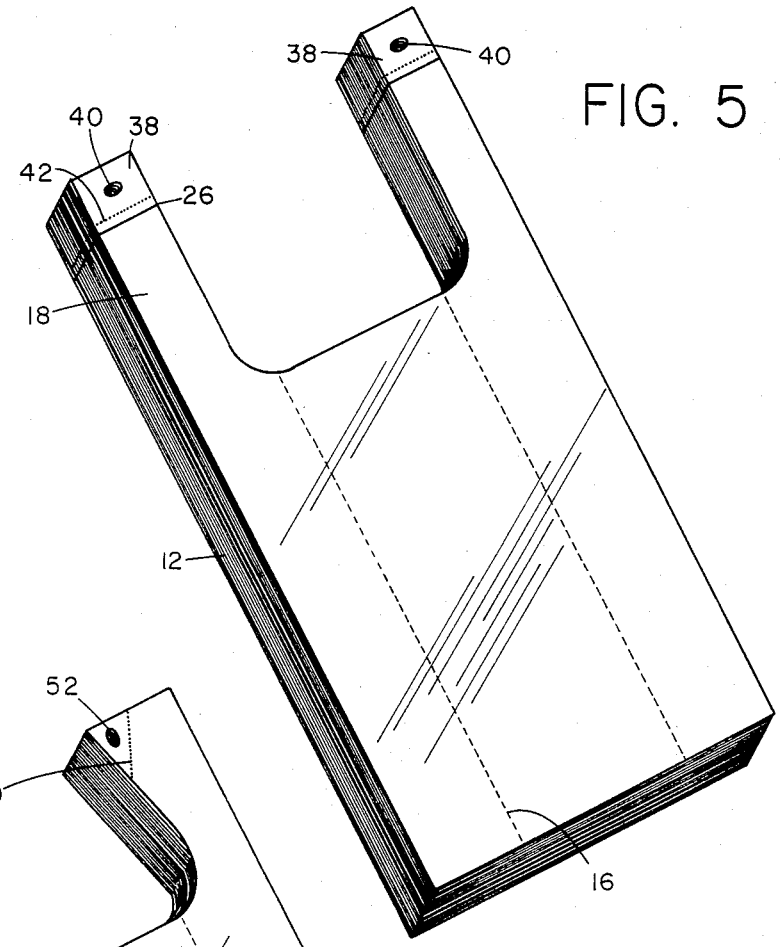
FIG. 5 is a prespective view of a modified form of the bag pack structure illustrated in FIG. 4.

FIGS. 4 and 5 illustrate variations on the bag pack of FIG. 1 in that instead of web 22 as a means of bonding the plurality of bags together and providing support means for the bag pack, there is shown tabs 32 having orifices 34 therein (FIG. 4) and tabs 38 having orifices 40 therein (FIG. 5). As in FIG. 1, tabs 32 are detachably connected to handle 18 in any suitable fashion, for example, by perforations 30 or stamped-out holes. In the case of the structure shown in FIG. 5, tabs 38 constitute a severable extension of handles 18. The handles are heat sealed at 26 as in FIG. 1, however, perforations 42 permit separation of handle 18 from tab 38.

In FIG. 4, the individual bags are formed with stress relief regions, areas, or notches 36 which are calculated to move lines of stress which would otherwise involve preweakened area 30, in a direction away from, that is, inward of the handle 18 thus minimizing or removing the tendency of the handle to tear at region 30. It will be noted that this type of stress relief region, area or notch would not be necessary in the bag structure shown in FIG. 5 since there are no preweakened or nicked areas along the handle edges of 18.

Figure 6:
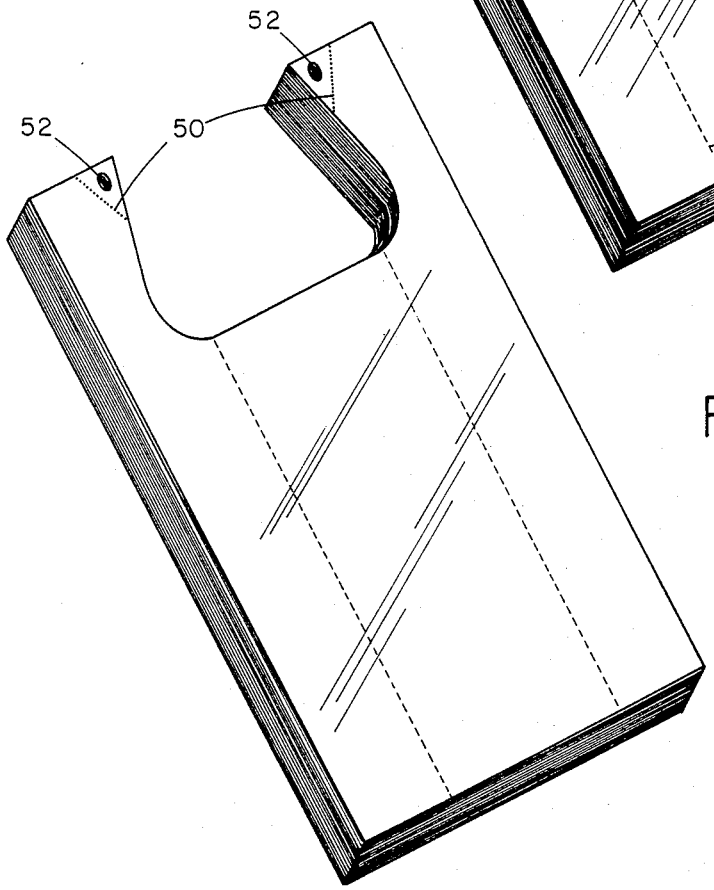
FIG. 6 is a perspective view of yet another modified form of the bag structures of FIGS. 4 and 5.

FIG. 6 is a variation of the structure of FIGS. 4 and 5. In this variation the bag handles are formed so that they are wider at the top than at the base thereof. This increased width permits a generally triangular tip of the four layers of plastic of the handles to be isolated by preweakened perforations 50. In the centers of these isolated regions holes 52 may be made for suspending a pack of the bags. The hole may also be made so as to fuse a plurality of the bags together. This will keep the bags in an orderly pack. The bags are somewhat slippery and without a means of keeping the bags together, orderly shipment and handling become a problem. In the wide top handle variation described above, the preweakened lines may be eliminated and holes (without fusing) may be formed in each handle top to accommodate temporary tying of a plurality of bags by any suitable means, e.g. a twist tie. This will permit the suspension of a pack of bags on a suitable bag holder having pegs or tongues. Thereafter, removal of the tying means permits individual dispensing of the bags with all of the wide handles intact, including the prepunched hole, useful for secondary consumer use.

FIG. 3 shows a variation in the structure of the bag pack depicted in FIG. 1. It is to be understood, however, that the variation discussed with respect to FIG. 3 could just as well be a variation in the bag packs of FIGS. 4, 5 and 6. The pertinent variation in FIG. 3 involves the compound configuation of the bag edges which constitute the bag mouth opening and the base of the handles. The compound configuration of this structure is made up of essentially three curves. Stress relief curve area or notch 44 is similar or identical to that shown in FIG. 4 at 36 and basically performs the same function of moving the lines of force created by a load in the bag away from preweakend regions 30 which remain after the handle is severed from the bag bonding means. Curve, notch or region 46 performs a dual function of likewise moving lines of stress away from bag mouth opening 48, and thus relieving the stresses on any prenicked or weakened areas in this region. Curve 46 also functions to give an extra length dimension to handle 18. This permits the original "pillow case" to be made to a length dimension shorter by a dimension corresponding to the radius of curvature of 46. This results in a corresponding savings in material without loss of bag volume.

It is to be understood that the bags described can vary in dimension and materials. For example, any thermoplastic material can be employed, for example, polyolefins, e.g. polyethylene, including blends of polyethylene, such as low density polyethylene with linear low density polyethylene copolymerized with another alpha olefin. There is nothing critical about the gauge dimension of the film employed in the bag. The bag should be capable of carrying the normal supermarket bag load which can range anywhere from a few pounds to about 35 pounds. As materials improve in the quality of their characteristics, this will permit film gauges extending down to 0.5 mils and less.

Another manner of describing the variation exemplified by FIG. 3 is that the line defined by the inside base of the handles and the bag mouth opening is a series of compound curves which include (a) a stress relief curve at the base of the handles extending in the direction of the outside edge of said handles, (b) stress relief curves at opposite ends of said bag mouth, and (c) a curve in the center region of said bag mouth opening said curve being of at least generally opposite amplitude to the bag mouth stress relief curves.

What is claimed is:

1. A bag pack comprising a plurality of stacked thermoplastic film bag structures, each bag comprising a front and rear bag wall and an open mouth top portion, said open mouth portion being characterized by having handles which are integral extensions of said walls, said handles being located at opposite ends of said mouth portion, said handles being in association with but detachable from bag bonding means bonding said bag structures into a bag pack, said bonding means comprising at least one web detachably but continuously extending from one oppositely disposed handle to the other, said webs being thermally bonded together by way of at least one heat formed orifice also serving as a suspension means for said pack.

2. The bag pack of claim 1 wherein said bags have gusseted side walls.

3. The bag pack of claim 1 wherein said handles are detachable from said web by way of pre-weakened regions.

4. The bag pack of claim 3 wherein said pre-weakened regions are lines of perforations.

5. The bag pack of claim 3 wherein said pre-weakened regions are lines of reduced material thickness.

6. A bag pack comprising a plurality of stacked thermoplastic bag structures, each bag comprising front and rear bag walls and an open mouth top portion, said open mouth portion being characterized by having handles which are integral extensions of said walls, said handles being located at opposite ends of said mouth portion, the line defined by the inside base of the handles and the bag mouth opening being compound curves which include (a) a stress relief curve at the base of the handle, extending in the direction of the outside edge of said handles; (b) stress relief curves at opposite ends of said bag mouth; and (c) a curve in the center region of said bag mouth opening, said curve being of at least generally opposite amplitude to the bag mouth stress relief curves, said handles being in association with but detachable from bag bonding means bonding said bag structure into a bag pack, said bonding means comprising at least one web detachably but continuously extending from one oppositely disposed handle to the other, said webs being thermally bonded together by way of at least one heat formed orifice also serving as a suspension means for said pack.

7. The bag pack of claim 6 wherein said bag structures have gusseted side walls.

* * * * *